US007966885B2

(12) United States Patent
Bayer et al.

(10) Patent No.: US 7,966,885 B2
(45) Date of Patent: Jun. 28, 2011

(54) SONOTRODE ESPECIALLY FOR ACCELERATING SHOT FOR ULTRASONIC SHOT PEENING

(75) Inventors: Erwin Bayer, Dachau (DE); Philipp Thümmler, München (DE); Jürgen Steinwandel, Uhldingen-Mühlhofen (DE)

(73) Assignee: MTU Aero Engines GmbH, Munich (DE)

( * ) Notice: Subject to any disclaimer, the term of this patent is extended or adjusted under 35 U.S.C. 154(b) by 295 days.

(21) Appl. No.: 12/281,222

(22) PCT Filed: Feb. 27, 2007

(86) PCT No.: PCT/DE2007/000362

§ 371 (c)(1),
(2), (4) Date: Nov. 5, 2008

(87) PCT Pub. No.: WO2007/101424

PCT Pub. Date: Sep. 13, 2007

(65) Prior Publication Data

US 2009/0293623 A1 Dec. 3, 2009

(30) Foreign Application Priority Data

Mar. 9, 2006 (DE) ..... 10 2006 010 880

(51) Int. Cl.
*B06B 3/00* (2006.01)

(52) U.S. Cl. ..... 73/663; 73/662

(58) Field of Classification Search ..... 73/663, 73/662; 72/53

See application file for complete search history.

(56) References Cited

U.S. PATENT DOCUMENTS

| | | | | |
|---|---|---|---|---|
| 4,122,725 | A | 10/1978 | Thompson | |
| 5,109,698 | A | 5/1992 | Owen | |
| 6,450,393 | B1 * | 9/2002 | Doumanidis et al. | 228/110.1 |
| 6,515,030 | B1 * | 2/2003 | Bechtel et al. | 516/58 |
| 7,210,347 | B2 * | 5/2007 | Nicu et al. | 73/504.12 |
| 7,810,699 | B1 * | 10/2010 | Cai et al. | 228/102 |
| 2009/0301152 | A1 * | 12/2009 | Bayer et al. | 72/53 |

FOREIGN PATENT DOCUMENTS

| | | |
|---|---|---|
| WO | WO 93/20247 | 10/1993 |

* cited by examiner

*Primary Examiner* — Jacques M Saint Surin
(74) *Attorney, Agent, or Firm* — Greer, Burns & Crain, Ltd.

(57) ABSTRACT

A sonotrode for accelerating shot for ultrasonic shot peening, includes at least one vibration exciter and a cover element that has an output side of the sonotrode, wherein the cover element is to be operated by means of the vibration exciter with a forced vibration such that the value of the vibration amplitude of the cover element corresponds essentially to the value of the vibration amplitude of the vibration exciter, where from this cover element another cover element is set out on the further side of the vibration exciter and in which between these two cover elements is stretched a majority of spring elements in the form of tension springs.

11 Claims, 1 Drawing Sheet

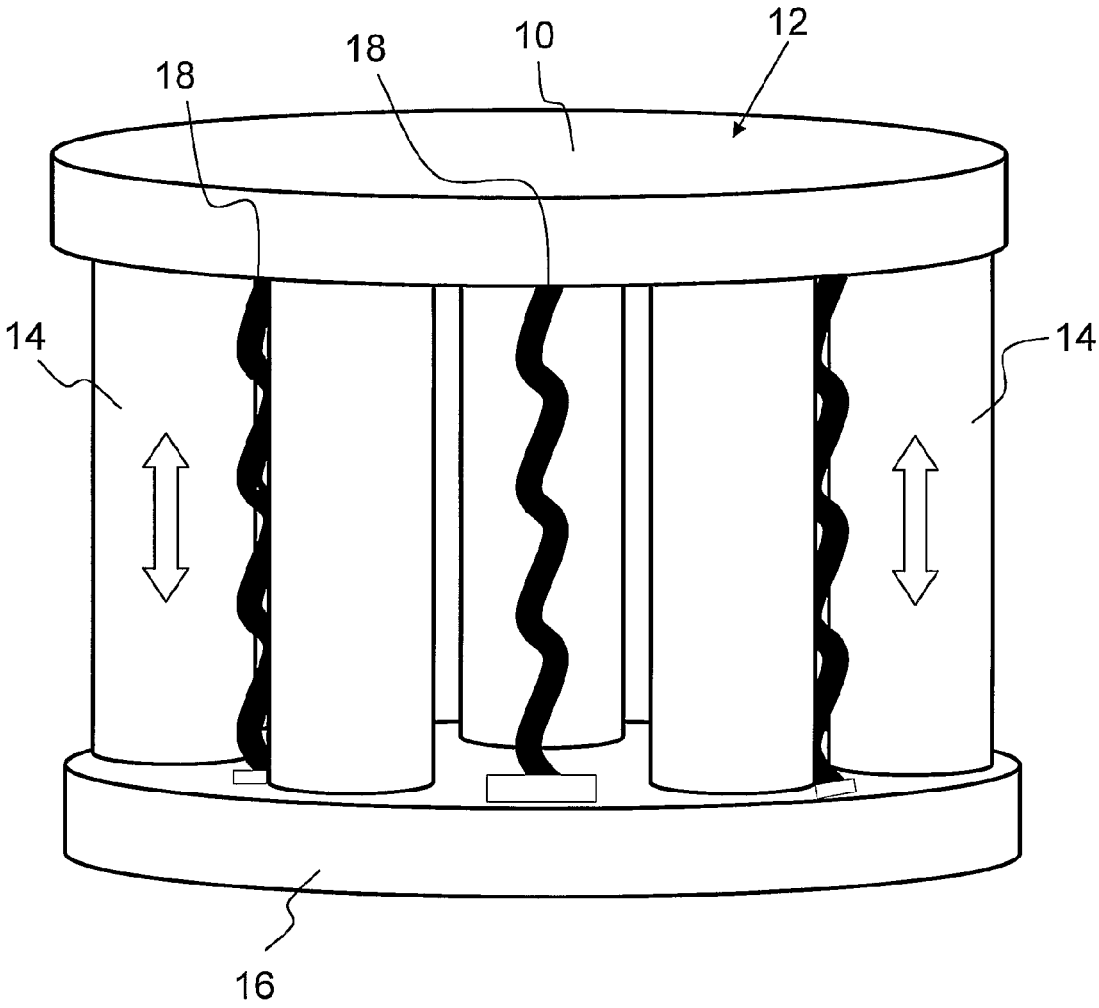
12
10
18
18
14
14
16

SONOTRODE ESPECIALLY FOR ACCELERATING SHOT FOR ULTRASONIC SHOT PEENING

The present invention relates to a sonotrode, in particular for accelerating shot for ultrasonic shot peening, of the type indicated in the preamble of patent claim 1.

Sonotrodes of this type are used for example for surface peening of metallic components, using shot as the peening agent. For this purpose, the sonotrode is used to accelerate the shot, for example inside a peening chamber, in order to process the surface of a workpiece that is also situated inside the peening chamber. This makes it possible for example to minimize or almost completely eliminate the occurrence of warps and material stresses at the edges of components of a gas turbine or aircraft engine. In addition, sonotrodes of this type are used for example to weld or to cut workpieces by means of ultrasound.

A sonotrode of this type is known from EP 0 711 626 A1, where, for use in an ultrasonic welding system, it is set into vibration by two ultrasonic vibration units. Each of these ultrasonic vibration units comprises a vibration exciter in the form of a piezoelectric converter that is connected, via a respective amplitude transformation piece, to a cover element situated at the output side of the sonotrode. The cover element has at its output side a work surface to which the workpiece may be welded, riveted, or countersunk, depending on the field of its application. Each of the two amplitude transformation pieces allocated to the associated ultrasonic vibration units acts as a downstream booster stage, made for example of a titanium alloy and producing the required acceleration amplitudes at the output side of the sonotrode by means of resonance effects. In other words, the specific eigenfrequencies of the amplitude transformation pieces are exploited in order to produce an amplification of the vibration amplitude or acceleration amplitude of the cover element at the output side of the sonotrode. In order to achieve such an amplification, in particular in ultrasonic methods having a frequency above 20 kHz, the amplitude transformation pieces or amplifier units must be made very long, so that the overall constructive length of the sonotrode is often greater than 500 mm. This has the result that the sonotrodes known from the prior art are often of only limited usefulness for complex components, because their constructive size often results in geometric overlapping with the component or workpiece.

Because the mass situated between the vibration exciter and the output side of the sonotrode during the amplification via resonance effects plays a significant role, a loss of mass, due for example to wear of the output-side work surface, results in significant loss of performance of the sonotrode.

The object of the present invention is therefore to improve a sonotrode of the type named above in such a way that it can be used even with geometrically complex components, and is capable of being operated without significant performance losses even given longer lifespans or durations of use.

According to the present invention, this object is achieved by a sonotrode having the features of patent claim 1. Advantageous constructions, embodying useful and non-trivial developments of the present invention, are described in the other patent claims.

The sonotrode according to the present invention proceeds from the basic idea that the cover element comprising the output side of the sonotrode is to be operated by means of the vibration exciter with a forced vibration such that the value of the vibration amplitude of the cover element corresponds essentially to the value of the vibration amplitude of the vibration exciter. In other words, it is provided according to the present invention that an amplification stage is not provided between the vibration exciter and the cover element situated at the output side of the sonotrode; rather, the value of the vibration amplitude produced by the vibration exciter is essentially adopted by the cover element. This has first of all the advantage that an amplification transformation stage having a long constructive length can be done without, so that overall a sonotrode, for example for ultrasonic peening using shot as a peening agent, can be provided whose constructive height is for example less than 70 mm. This makes it possible to easily process even extremely complex components, such as a gas turbine or aircraft engine, including in particular even the inner areas of these components. In addition, a loss of mass due to frictional wear at the output side of the cover element will result in very low performance losses, because the cover plate executes a forced vibration, and does not exhibit an amplified acceleration amplitude or vibration amplitude due to resonance effects.

In a further construction of the present invention, it has proved advantageous to connect the cover element immediately to the at least one vibration exciter. In this way, a forced vibration of the cover element can be achieved in a particularly simple manner whose vibration amplitude value corresponds essentially to that of the vibration exciter.

Using a vibration exciter fashioned as an ultrasonic piezoactuator, already with an extremely low constructive height of the actuator it is easily possible to produce an ultrasonic vibration whose vibration amplitude value is comparatively relatively high. Thus, given corresponding dimensioning, it is for example possible, using a column-shaped ultrasonic piezoactuator having a length of approximately 50 mm, to realize a forced vibration amplitude of approximately 50 μm. It is clear that overall the value of the vibration amplitude of the vibration exciter is a function of its dimensions, in particular of its length. A length of approximately 40 mm to 60 mm, preferably approximately 50 mm, of the vibration exciter has in particular proven advantageous, because this length makes it easy to achieve the value, required for ultrasonic peening, of the vibration amplitude of the cover element or of the vibration exciter in the range from approximately 40 μm to 60 μm, preferably approximately 50 μm.

In another construction of the present invention, it has in particular proved advantageous to provide a plurality of vibration exciters whose vibration amplitude values are essentially identical and correspond to the vibration amplitude value of the cover element. Such a plurality of vibration exciters makes it easily possible to achieve the forced vibration desired according to the present invention even given a correspondingly larger cover element, so that the cover element is excited with an essentially equally large vibration amplitude value over its entire extension. Accordingly, given a plurality of vibration exciters it is easily possible to operate both a central region and also the outer edge regions of the cover element with an almost identical vibration amplitude value. However, for this purpose it is in particular necessary for the plurality of vibration exciters to be operated with phase-identical vibration.

In order to easily connect the cover element to the at least one vibration exciter, in a further construction of the present invention it has proven advantageous to situate this cover element on the vibration exciter via at least one spring element, with a pre-tension. This ensures, in a simple and reliable manner, that the cover element is forced to vibrate by the vibration exciter. Here, the spring constant of the at least one spring element is preferably selected such that its main resonance lies outside the operating frequency of the at least one vibration exciter.

In addition, it has proven advantageous to provide the output side of the cover element with a high-strength material, such as a tungsten carbide-cobalt alloy. This can prevent significant material loss or frictional wear even given longer useful lifespans of the cover element, in particular during ultrasonic shot peening.

Because the cover element is operated with a forced vibration, its surface forming the output side of the sonotrode can be provided with a structuring, for example made up of corrugations, dents, grooves, or the like, in order to propagate the distribution of the direction of acceleration of the shot via the surface of the cover element, achieving as uniform a peening pattern as possible.

Further advantages, features, and details of the present invention result from the following description of a preferred exemplary embodiment, and on the basis of the drawing, which shows:

A schematic perspective view of a sonotrode comprising a plurality of vibration exciters in the form of column-shaped ultrasonic piezoactuators, an upper cover element, comprising the output side of the sonotrode, and a lower cover element being connected immediately to the vibration exciters, and the upper cover element being held on the vibration exciters with a pre-tension by means of a spring element that extends between the two cover elements.

The FIGURE shows a schematic perspective view of a sonotrode that has at its upper side a disk-shaped cover element 10 having a thickness of approximately 10 mm. The upper surface of cover element 10 forms output side 12 of the sonotrode, with which in the present exemplary embodiment shot are accelerated or excited for ultrasonic shot peening. In other words, the sonotrode can for example be situated at a peening chamber (not shown) for surface peening in such a way that within this chamber a cloud of shot can be produced by means of the vibrating output side 12 of the sonotrode. In the present exemplary embodiment, disk-shaped cover element 10 has a diameter of, for example, 40 mm to 80 mm. In the present exemplary embodiment, on the underside of cover element 10 there are situated a plurality of vibration exciters 14, fashioned in this case as column-shaped ultrasonic piezoactuators having an essentially cylindrical basic shape. In the present exemplary embodiment, vibration exciters 14 have a length of approximately 40 mm to 60 mm, preferably approximately 50 mm. In the present example, vibration exciters 14 have a diameter of approximately 5 mm to 30 mm. It can be seen that in the present exemplary embodiment upper cover element 10 is upwardly immediately connected to, or stands in contact with, vibration exciters 14. In addition, in the present exemplary embodiment vibration exciters 14 are distributed approximately uniformly around the outer periphery of cover element 10. In other words, vibration exciters 10 are situated in a circle that runs close to the outer periphery of cover element 10. However, within the scope of the present invention it is to be noted that other arrangements of vibration exciters 14 are also possible, depending on the dimensions of the sonotrode. In particular, it is also possible to position one or more vibration exciters 14 in a central region of the cover element.

On the side of vibration exciters 14 facing away from upper cover element 10, there is situated another cover element 16 whose shape is fashioned so as to match that of upper cover element 10, which forms output side 12 of the sonotrode. The two cover elements 10, 16 run in parallel planes to one another. Lower cover element 16 is also connected immediately to vibration exciters 14, or stands in immediate contact therewith.

Overall, the two cover elements 10, 16, and vibration exciters 14 situated between them, result in a sonotrode having an essentially cylindrical shape, whose constructive height is here preferably smaller than 70 mm, or is approximately 70 mm. Lower cover element 16 acts as a mount for the sonotrode, and is for example fixedly clamped in place, so that the vibration required to accelerate the shot for ultrasonic shot peening can be produced at output side 12 of upper cover element 10.

Between the two cover elements 10, 16, in the present exemplary embodiment there extend a plurality of spring elements 18 in the form of tensile springs that are connected at their ends to the two cover elements 10, 16. Spring elements 18 are distributed uniformly between the two cover elements 10, 16. In addition, spring elements 18 are loaded with a pre-tension, so that in particular upper cover element 10 is held with a pre-tension on vibration exciters 14. The spring constant of spring elements 18 is selected such that its main resonance lies outside the working frequency of vibration exciters 14.

For the operation of the sonotrode, vibration exciters 14 are operated with a frequency of greater than 20 kHz. The vibration amplitude value of vibration exciters 14 is in the range from approximately 40 μm to 60 μm, and is preferably approximately 50 μm.

Upper cover element 10, held on vibration exciters 14 by spring elements 18 under pre-tension, is set into forced vibration by vibration exciters 14 due to being situated immediately over them, so that the vibration amplitude value of upper cover element 10 corresponds essentially to the vibration amplitude value of vibration exciters 14. Correspondingly, cover element 10, or its output side 12, is excited with a vibration amplitude value of approximately 40 μm to 60 μm, preferably approximately 50 μm. In order to achieve the forced vibration of cover element 10, vibration exciters 14 should be operated in phase-identical vibration.

Output side 12 of upper cover element 10 is made of a high-strength material, such as a tungsten carbide-cobalt alloy, so that no wear, or only very minimal wear, can occur in the area of contact with the shot. In addition, output side 12 of upper cover element 10 is provided with a structuring, for example corrugations, dents, grooves, or the like, in order to propagate the distribution of the direction of acceleration, achieving as uniform as possible a peening pattern of the shot during surface peening.

It can be seen that the construction according to the present invention does not result in a shift in the vibration amplitude even given a change in the surface at output side 12, because the forced vibration accelerates both upper cover element 10 and the shot used for the surface peening.

The scope of the present invention also comprises the consideration that the sonotrode, and in particular its cover elements 10, 16, as well as its vibration exciters 14, can also have different dimensions, suitably matched to one another. However, it is essential that the vibration amplitude value of vibration exciters 14 correspond essentially to the vibration amplitude value of cover element 10. Also within the scope of the present invention is the consideration that the sonotrode here described may be used not only for surface peening or ultrasonic shot peening using corresponding shot, but can also be used for other applications, such as welding, cutting, or riveting of workpieces.

The invention claimed is:

1. A sonotrode for accelerating shot for ultrasonic shot peening, comprising:

at least one vibration exciter and a cover element that comprises an output side of the sonotrode, wherein the cover element is to be operated by means of the vibration exciter with a forced vibration such that the value of the vibration amplitude of the cover element corresponds essentially to the value of the vibration amplitude of the vibration exciter, where from this cover element another cover element is set out on the further side of the vibration exciter and in which between these two cover elements is stretched a majority of spring elements in the form of tension springs.

2. The sonotrode as recited in claim 1, characterized in that the cover element is connected immediately to the at least one vibration exciter.

3. The sonotrode as recited in claim 1, characterized in that the at least one vibration exciter is an ultrasonic piezoactuator.

4. The sonotrode as recited in claim 1, wherein the value of the vibration amplitude of the cover element or the value of the vibration amplitude of the vibration exciter is in the range from approximately 40 μm to 60 μm, and is preferably approximately 50 μm.

5. The sonotrode as recited in one claim 1, wherein the at least one vibration exciter has a length of approximately 40 mm to 60 mm, preferably approximately 50 mm.

6. The sonotrode as recited in claim 1, wherein a plurality of vibration exciters are provided whose vibration amplitude values are essentially identical and correspond to the value of the vibration amplitude of the cover element.

7. The sonotrode as recited in claim 6, characterized in that the plurality of vibration exciters are operated with phase-identical vibration.

8. The sonotrode as recited in claim 1, wherein the cover element is held on the at least one vibration exciter under pre-tension via at least one spring element.

9. The sonotrode as recited in claim 8, characterized in that the spring constant of the at least one spring element is designed such that its main resonance lies outside the operating frequency of the at least one vibration exciter.

10. The sonotrode as recited in claim 1, wherein the output side of the cover element is made of a high-strength material.

11. The sonotrode as recited in claim 1, wherein the output side of the cover element is provided with a structuring.

* * * * *